US006314671B1

(12) United States Patent
Gering

(10) Patent No.: US 6,314,671 B1
(45) Date of Patent: Nov. 13, 2001

(54) FIRE ARM EQUIPPED WITH AN ENABLING SYSTEM

(75) Inventor: Armand Gering, Liege (BE)

(73) Assignee: FN Herstal, S.A., Herstal (BE)

( * ) Notice: Subject to any disclaimer, the term of this patent is extended or adjusted under 35 U.S.C. 154(b) by 0 days.

(21) Appl. No.: 09/519,580

(22) Filed: Mar. 6, 2000

(30) Foreign Application Priority Data

Aug. 6, 1999 (BE) ..... 9900540

(51) Int. Cl.[7] ..... F41A 17/00
(52) U.S. Cl. ..... 42/70.11
(58) Field of Search ..... 42/70.11, 70.01, 42/84

(56) References Cited

U.S. PATENT DOCUMENTS

| | | | | |
|---|---|---|---|---|
| 4,003,152 | * | 1/1977 | Barker et al. | 42/70.11 |
| 4,154,014 | * | 5/1979 | Smith | 42/70.11 |
| 4,488,370 | | 12/1984 | Lemelson | 42/70.11 |
| 4,682,435 | | 7/1987 | Heltzel | 42/70.11 |
| 5,062,232 | * | 11/1991 | Eppler | 42/70.11 |
| 5,068,989 | * | 12/1991 | Martin | 42/70.01 |
| 5,303,495 | * | 4/1994 | Harthcock | 42/84 |
| 5,459,957 | * | 10/1995 | Winer | 42/70.11 |
| 5,461,812 | | 10/1995 | Bennett | 42/70.11 |
| 5,537,771 | * | 7/1996 | Martin | 42/70.01 |
| 5,546,690 | * | 8/1996 | Ciluffo | 42/70.11 |
| 5,564,211 | * | 10/1996 | Mossberg et al. | 42/70.11 |
| 5,675,925 | * | 10/1997 | Wurger | 42/70.11 |
| 5,715,623 | * | 2/1998 | Mackey, III | 42/1.01 |
| 5,779,114 | * | 7/1998 | Owens | 224/193 |
| 5,896,691 | | 4/1999 | Kaminski et al. | 42/70.11 |
| 5,924,232 | * | 7/1999 | Rhoden et al. | 42/70.11 |
| 6,154,995 | * | 12/2000 | Lenoir et al. | 42/70.07 |
| 6,185,852 | * | 2/2001 | Whalen et al. | 42/70.11 |
| 6,249,952 | * | 4/2001 | Mossberg et al. | 42/70.11 |

FOREIGN PATENT DOCUMENTS

| | | |
|---|---|---|
| 44 46 020 A1 | 6/1996 | (DE) . |
| WO 98/04880 | 2/1998 | (WO) . |

* cited by examiner

*Primary Examiner*—Michael J. Carone
*Assistant Examiner*—Denise J Buckley
(74) *Attorney, Agent, or Firm*—Bacon & Thomas

(57) ABSTRACT

The invention concerns a fire arm equipped with an enabling system which comprises a transmitter/receiver (6) of ultrasonic waves mounted on the fire arm, a unit (5) to be carried by the shooter, containing means (13) for sending back a signal transmitted to the latter by said transmitter/receiver (6) and a monitoring device (9) monitoring the signal received by the above-mentioned receiving part, controlling a device (10) which can prevent any firing. The enabling system contains a timer (7) which can measure the length of time between the transmission of a signal by the transmitter/receiver (6) and its reception by the latter, and a device (8) to calculate the distance covered by said signal, whereby the monitoring device (9) only makes it possible to fire when it recognizes the signal and when on top of that the above-mentioned distance is inferior to a certain limit.

8 Claims, 1 Drawing Sheet

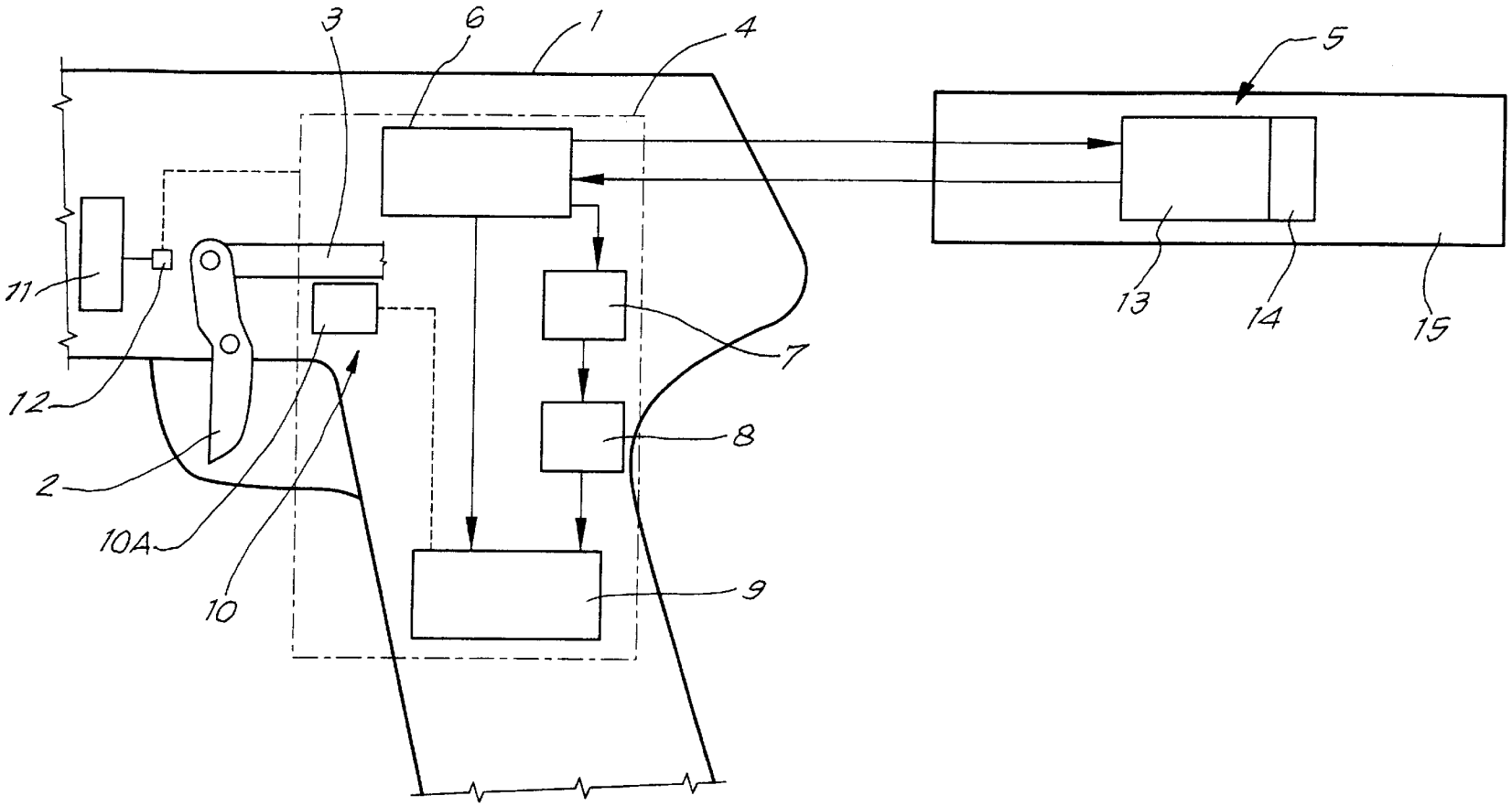
15
5
14
13
4
7
8
9
1
6
3
10
10A
2
12
11

FIRE ARM EQUIPPED WITH AN ENABLING SYSTEM

BACKGROUND OF THE INVENTION

1. Field of the Invention

The invention concerns a fire arm equipped with an enabling system, whereby the fire arm contains a device which can prevent any firing, whereas the enabling system contains a transmitter/receiver mounted on the fire arm, a unit to be carried by the shooter containing means to send back a signal transmitted by the transmitting part of the above-mentioned transmitter/receiver to the receiving part of this transmitter/receiver, and a monitoring device to monitor the signal received by said receiving part and to control the device which can prevent any firing, whereby the latter actually prevents the firing if the monitoring device does not recognize said signal as that of an authorized shooter.

2. Discussion of the Related Art

Such an arm, which is often called an intelligent fire arm or 'smart gun', is meant to prevent its being used by a non-authorized person.

A fire arm of this type is described in U.S. Pat. No. 5,704,153. The transmitter/receiver mounted on the fire arm is a radio transmitter/receiver transmitting, for example at the moment when the grip of the fire arm is seized, a preferably coded radio signal of a specific frequency, for example in the order of 900 MHz, is sent to a transponder built-in in a ring which is worn by the shooter, which returns the signal to the first transmitter/receiver.

If the latter receives a correct and sufficiently strong signal, it will activate a solenoid which unlocks a bolt element of the firing mechanism, thus enabling the shooter to fire.

Whereas, in traditional coding systems, the distance between the transmitter of the coded signal and the receiver is of no importance, this is quite different in case of a fire arm. For it is not exceptional that a criminal filches the fire arm of an authorized person. We must in this case prevent the criminal from shooting at the authorized person with the fire arm.

The principle of the above-mentioned known fire arm and of other similar fire arms making use of electromagnetic waves as a means to identify the authorized person in this sort of situations, is that, when the fire arm is removed from the person carrying the means for sending back a signal, for example in a ring, the strength of the signal which is sent back to the receiving part of the transmitter/receiver mounted on the fire arm becomes too weak for the monitoring device to be activated.

The attenuation of the signal is not always influenced by the mere distance between the means for sending back a signal and the transmitter/receiver. It can be influenced by the direction of the antennas, the condition of the battery supplying the power to the above-mentioned means and to the transmitter/receiver, the presence of metal objects, etc.

Due to the above-mentioned influences of the direction of the antennas, of electromagnetic interference, etc. it can happen that the authorized shooter is not identified, whereas the identification means worn by him are situated at the appropriate distance from the transmitter/receiver mounted on the fire arm. Thus, the enabling system of these fire arms is not entirely reliable.

SUMMARY OF THE INVENTION

The invention aims to remedy this disadvantage and to provide a fire arm equipped with a very reliable enabling system.

This aim is reached in that the transmitter/receiver is a transmitter/receiver of matter waves, and in that the enabling system contains a timer which can measure the length of time between the transmission of a signal by the transmitting part of the transmitter/receiver and its reception by the receiving part of this transmitter/receiver, and a device to calculate the distance covered by this signal on the basis of the measured time, whereby the monitoring device only makes it possible to fire when it has recognized the signal and when on top of that the above-mentioned distance is inferior to a certain limit.

The distance covered by the signal can thus be exactly determined. This distance is equal to the double of the distance between the means sending back a signal from the unit to be carried by the shooter and the transmitter/receiver mounted on the fire arm. The maximum distance at which the fire arm can be situated from the unit in order to enable the firing can thus be used as a supplementary condition, increasing the safety of the enabling system.

Matter waves are for example sound waves, infrasonic waves or ultrasonic waves.

The means for sending back a signal from the unit to be carried by the shooter are preferably mounted in an accessory worn by the shooter, in particular a bracelet, a ring, a pendant, a belt buckle, etc.

The identification of the authorized shooter can be derived from a specific frequency of the signal which is sent back by the above-mentioned means, but the unit preferably contains coding means which can code the returned signal.

The device which can prevent the firing may contain an electric control element, such as an electromagnet which can disconnect a piece of the firing mechanism of the fire arm.

BRIEF DESCRIPTION OF THE DRAWING

In order to better explain the characteristics of the invention, the following embodiment according to the invention is described as an example only without being limitative in any way, with reference to the accompanying drawing, in which is represented a section of a part of a fire arm equipped with an enabling system according to the invention.

DESCRIPTION OF THE PREFERRED EMBODIMENT

The fire arm, of which a part is represented in the FIGURE, contains a frame 1 in which is mounted a firing mechanism of which only the trigger 2 and a control rod 3 coupled to the trigger 2 are represented.

This fire arm is equipped with a fire enabling system containing an electronic device 4 mounted on the fire arm on the one hand, for example inside the frame 1, and a unit to be carried by the shooter.

The electronic device 4 contains a transmitter/receiver 6 of matter waves, i.e. ultrasonic waves having a frequency of for example 40 kHz, which is connected to a timer 7 which can measure the length of time between the transmission of an ultrasonic signal by the transmitting part of this transmitter/receiver 6 and its reception by the receiving part of the transmitter/receiver 6.

Said timer 7 is in turn connected to a calculating device 8 which can determine the distance covered by the ultrasonic signal on the basis of the time measured by the timer 7.

The transmitter/receiver 6 as well as the calculating device 8 are connected to a monitoring device 9 which controls a device 10 to prevent any firing, which in the given example is an electric control device 10A which can disconnect the firing device, for example an electromagnet attracting the control rod 3 to interrupt the mechanical transmission between the trigger 2 and the striker.

Instead of disconnecting the firing device, the control element 10A can lock this device. Thus, according to a variant, the electric control element 10A can activate a stop preventing a piece of the firing mechanism from moving. This stop may consist of a heart surrounded by a solenoid.

The electronic device 4 is fed by a power source 11 via a micro switch 12 which is controlled by the trigger 2.

The unit 5 consists of means 13 sending back an ultrasonic signal and of coding means 14 connected thereto to code this returned signal.

Said electronic unit 5 is built-in in a vestimentary accessory to be worn by the shooter, preferably an accessory worn at a short distance from the fire arm which is held in the shooter's hand, in the given example a bracelet 15. According to variants, this unit 5 can be built-in in a ring, a pendant or a belt buckle.

The firing enabling system works as follows:

As soon as the shooter squeezes the trigger 2, the micro switch 12 is closed and the electronic device 4 is activated.

The transmitter/receiver 6 immediately transmits an ultrasonic signal while the timer 7 starts counting.

If the shooter wears the bracelet 15, the above-mentioned signal is received by the unit 5. The means 13 for sending back a signal return this signal in a coded form, i.e. after it has been coded by the coding means 14 as a function of the identity of the shooter(s) which is/are authorized to fire.

As soon as the receiving part of the transmitter/receiver 6 receives this coded signal, the timer 7 stops and the calculating device 8 determines the distance covered by the signal on the basis of the measured time, which can be done with great precision. This also implies that the distance between the transmitter/receiver 6 and the unit 4 is determined, as it is half of the distance covered by the signal.

This distance measurement is sent to the monitoring device 9 which checks whether the distance does not exceed a certain limit. The distance between the fire arm and the bracelet 15 may for example not exceed 20 cm.

Simultaneously, the monitoring device 9 checks whether the signal which has been received back is adequately coded.

If the distance does not exceed the limit and if the monitoring device 9 moreover recognizes the code as being that of the authorized person, the enabling system makes it possible to fire, or in other words it does not activate the device 10 which can prevent the firing.

If either of the two conditions is not met, the monitoring device 9 will order the device 10 to actually prevent the firing, for example it will power the electric control element 10A which disconnects the firing device.

When for example a criminal has filched the fire arm of the authorized shooter and aims at the latter, the monitoring device 9 will recognize the signal, but the distance between this fire arm and the unit 5 in the bracelet 15 will be too large, and the control device 9 will prevent the criminal from shooting.

It is clear that the invention is by no means limited to the above-described embodiment represented in the accompanying drawing; on the contrary, many modifications can be made to the above-described fire arm while still remaining within the scope of the invention.

What is claimed is:

1. A fire arm equipped with an enabling system, whereby the fire arm contains a device which can prevent any firing, whereas the enabling system contains a transmitter/receiver mounted on the fire arm, a unit to be carried by the shooter containing means to send back a signal transmitted by the transmitting part of the above-mentioned transmitter/receiver to the receiving part of this transmitter/receiver, and a monitoring device to monitor the signal received by said receiving part and to control the device which can prevent any firing, whereby the latter actually prevents the firing if the monitoring device does not recognize said signal as that of an authorized shooter, in which the transmitter/receiver is a transmitter/receiver of matter waves, and in that the enabling system contains a timer which can measure the length of time between the transmission of a signal by the transmitting part of the transmitter/receiver and its reception by the receiving part of this transmitter/receiver, and a device to calculate the distance covered by this signal on the basis of the measured time, whereby the monitoring device only makes it possible to fire when it has recognized the signal and when on top of that the above-mentioned distance is inferior to a certain limit.

2. The fire arm of claim 1, in which the transmitter/receiver is a transmitter/receiver of sound waves, infrasonic waves or ultrasonic waves.

3. The fire arm of claim 1, in which the means for sending back a signal of the unit to be carried by the shooter are mounted in an accessory to be worn by the shooter, for example a bracelet, a ring, a pendant or a belt buckle.

4. The fire arm of claim 1, in which the unit to be carried by the shooter contains coding means which can code the signal which is sent back by the means for sending back a signal.

5. The fire arm of claim 1, in which the enabling system is connected to "an element" which is controlled by the trigger of the fire arm, such that it is activated as soon as the trigger is squeezed.

6. The fire arm of claim 1, in which the device which can prevent any firing contains an electric control element which acts on the firing mechanism and which is controlled by the monitoring device.

7. The fire arm of claim 6, in which the electric control element is an element which can disconnect the firing device.

8. The fire arm of claim 7, in which the electric control element is an electromagnet which can disconnect a piece of the firing mechanism of the fire arm.

* * * * *